US005433028A

United States Patent [19]

Novak et al.

[11] Patent Number: 5,433,028

[45] Date of Patent: Jul. 18, 1995

[54] GUN'S TRIGGER LOCKING MECHANISM

[76] Inventors: Vicente N. Novak, 14268 Chase St., Panorama City, Calif. 91402-3137; Amir H. F. Fard, 6210 Reseda Blvd. #309, Reseda, Calif. 91335

[21] Appl. No.: 265,129

[22] Filed: Jun. 24, 1994

[51] Int. Cl.[6] ..... F41A 17/46

[52] U.S. Cl. ..... 42/70.06; 42/70.11

[58] Field of Search ..... 42/70.11, 70.06, 70.07

[56] References Cited

U.S. PATENT DOCUMENTS

| | | | |
|---|---|---|---|
| 2,979,845 | 12/1958 | Christiansen | 42/70 |
| 3,978,604 | 9/1976 | Smith | 42/70 |
| 4,110,928 | 9/1978 | Smith | 42/66 |
| 4,154,014 | 5/1979 | Smith | 42/70 |

*Primary Examiner*—Charles T. Jordan
*Assistant Examiner*—Christopher K. Montgomery

[57] ABSTRACT

This device selectively locks the trigger of a firearm by the action of a hollow pin that, pushed by a spring, fits inside a cavity made at the bottom of the trigger. This hollow pin is welded to a flat steel bar that fits along a groove inside the horizontal part of the trigger guard. This trigger guard is made of a non-magnetizable material. The flat steel bar pivots by the use of a horizontal pin that can be locked at the front of the trigger guard, depending of the needs of the designers of the different guns. This flat steel bar has an up and down motion to lock and unlock the trigger.

To release the trigger, the user of the gun wears a flat magnet with a magnetization pattern parallel to its thickness. This magnet should be attached to the exterior surface of the second phalanx of the middle finger of the shooting hand either mounted to a ring or sewn to a glove. In this way the magnet will be located under the trigger guard when the gun is held, and the pulling of the magnet will move the bar and the locking pin (hollow pin) down, unlocking the firearm.

If the gun is dropped or taken away from the owner, it won't shoot. Neither will shoot if someone takes the gun unaware of the need of the magnet.

1 Claim, 4 Drawing Sheets

GUN'S TRIGGER LOCKING MECHANISM

CROSS REFERENCES

U.S. Pat. No. 2,979,845 4/1961 Christiansen
U.S. Pat. No. 3,978,604 9/1976 Smith
U.S. Pat. No. 4,067,132 1/1978 Smith
U.S. Pat. No. 4,110,928 9/1978 Smith
U.S. Pat. No. 4,154,014 5/1979 Smith

BACKGROUND OF THE INVENTION

1. Field of the Invention

Each year people are shot by unauthorized firearm users. Our main concerns are children playing with firearms and law enforcement officers being disarmed and shot with their own guns. In an effort to prevent the undesired firing of a firearm we have designed this safety device. It relates to a mechanical trigger locking apparatus and a magnetic unlocking key. Our invention will prevent anyone other than the owner from operating a firearm.

2. Description of the Prior Art

There are some safety devices for firearms patented in the U.S. They are very sophisticated and or easy to deactivate due to parts of the mechanism which are not concealed. These parts can be moved by the use of a pin-like hairpin. Our invention is simple, only three pieces within the trigger guard and a magnet from without the gun are the components. This design is inviolable due to the firearm looks no different than a regular gun. The locking mechanism is concealed within the trigger guard and it is out of reach.

SUMMARY

Our invention is a device that selectively locks the trigger of guns. In order to unlock the trigger, a magnet is required. Our design is composed of a hollow pin that fits into a cavity located at the bottom of the trigger; a flat steel bar welded to the hollow pin; a horizontally situated pin where the flat steel bar pivots; a spring located inside the hollow pin that pushes this pin upwards; a magnet form without the gun that unlocks the trigger by pulling the locking mechanism down.

BRIEF DESCRIPTION OF THE DRAWINGS

FIG. 1 shows the trigger (#1) locked by the hollow pin (#2). This hollow pin is welded to the flat steel bar (#4), but this two pieces can be made from one piece of steel upon the preference of the designed. The flat steel bar and the hollow pin are pushed upwards by the spring (#3), locking the trigger (#1). The flat steel bar (#4) pivots at the front end of the trigger guard (#5) by a transversely mounted horizontal pin (#6).

FIG. 2 depicts the unlocking of the trigger (#1) by the action of the magnet (#7) that pulling the flat steel bar (#4) and the hollow pin (#2), releases the trigger (#1).

Figure 1:
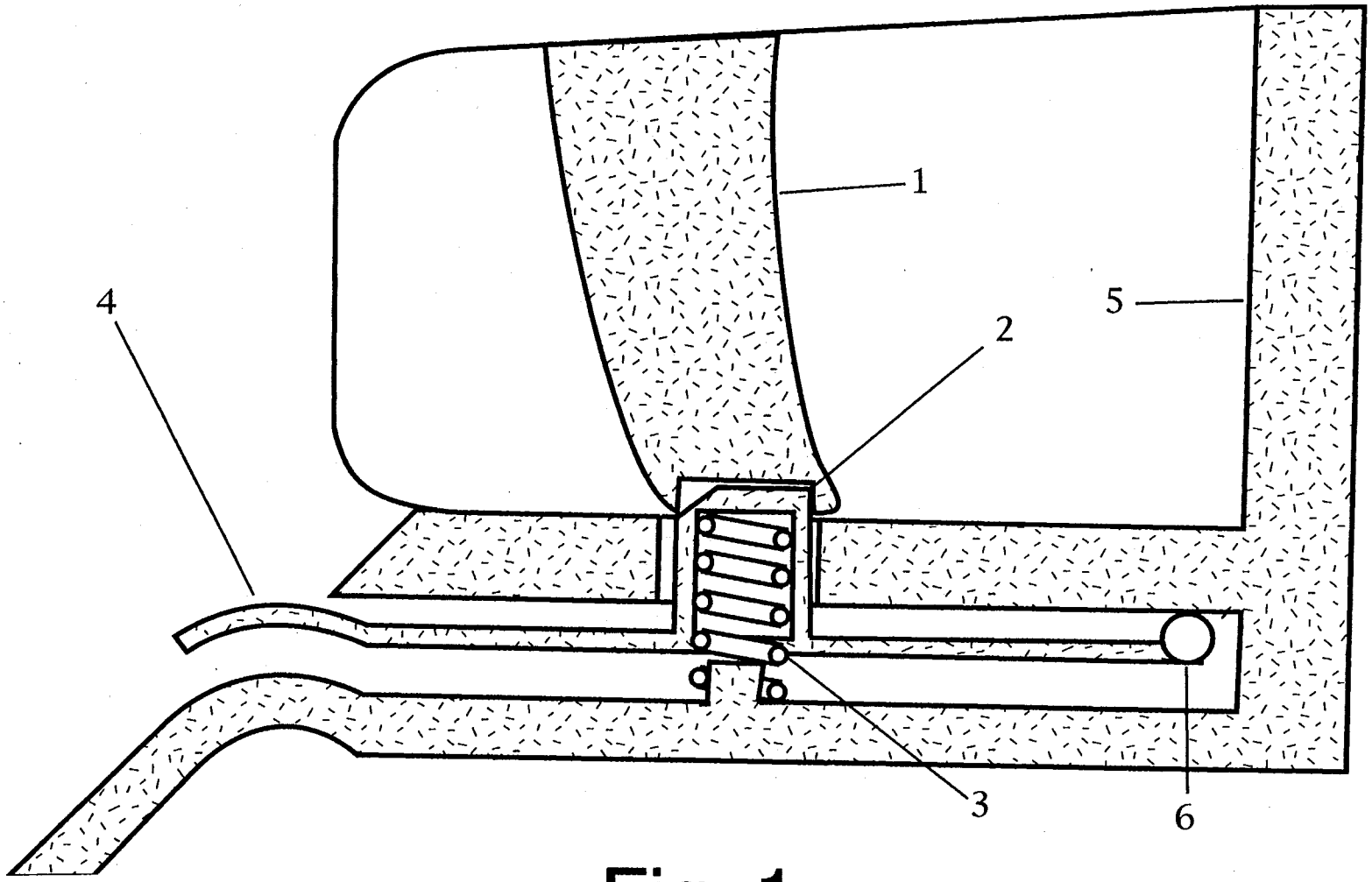
FIG. 1
Figure 2:
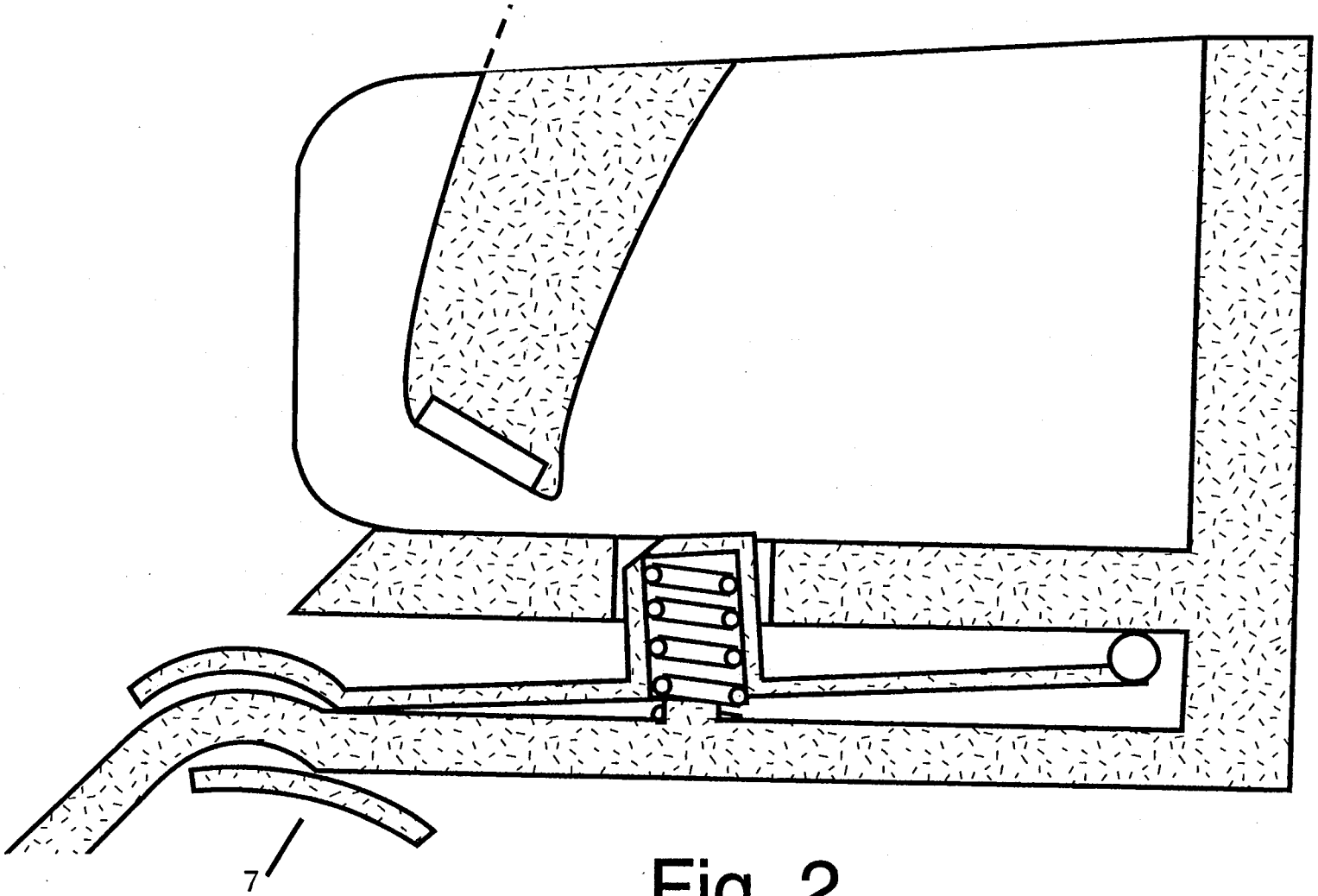
FIG. 2

This figure shows the flat steel bar (#4) pivoting into the horizontal pin (#6), in this drawing it is located at the rear end of the horizontal part of the trigger guard (#5).

FIG. 4

This drawings shows the trigger locking mechanism adapted to a sliding kind of trigger.

DESCRIPTION OF THE PREFERRED EMBODIMENT

The Gun's Trigger Locking Mechanism is a safety device designed to prevent the unauthorized use of a firearm. The locking apparatus fits inside of a non-magnetizable hollow trigger guard 5 and consists of a hollow pin 2, a spring 3, a flat steel bar 4 and a transversely horizontal pin 6.

In the locked position the hollow pin 2 protrudes through the horizontal part of the trigger guard 5 to fit into a cavity at the bottom of the trigger 1. By doing so this hollow pin 2 prevents the backwards movement of the trigger 1, preventing the firing of the weapon. The forward motion of the trigger 1 is permitted because there are chamfers at the top-rear border of the hollow pin 2 and at the bottom-front border of the trigger 1. The trigger 1 pushes the hollow pin 2 down in its forward movement, and the spring 3 pushed the hollow pin 2 back up to lock the trigger 1.

The hollow pin 2 and the flat steel bar 4 can be two separate pieces that should be welded together or can be made from one piece of steel. To unlock the trigger 1 a flat magnet 7 with a magnetization parallel to its thickness should be held directly under the trigger guard 5. This position of the magnet 7 is achieved by mounting it on a finder ring or sewing it to the middle finger of a glove. The user of the gun has to wear either a ring or a glove with the magnet 7 to operate the gun. In both cases the magnet 7 is to rest on the exterior border on the second phalanx of the middle finger of the triggering hand. In doing so the magnet 7 attracts the flat steel bar 4 down, this in turn pulls the hollow pin 2 down, out of the cavity at the bottom of the trigger 1, thereby unlocking the gun.

Figure 3:
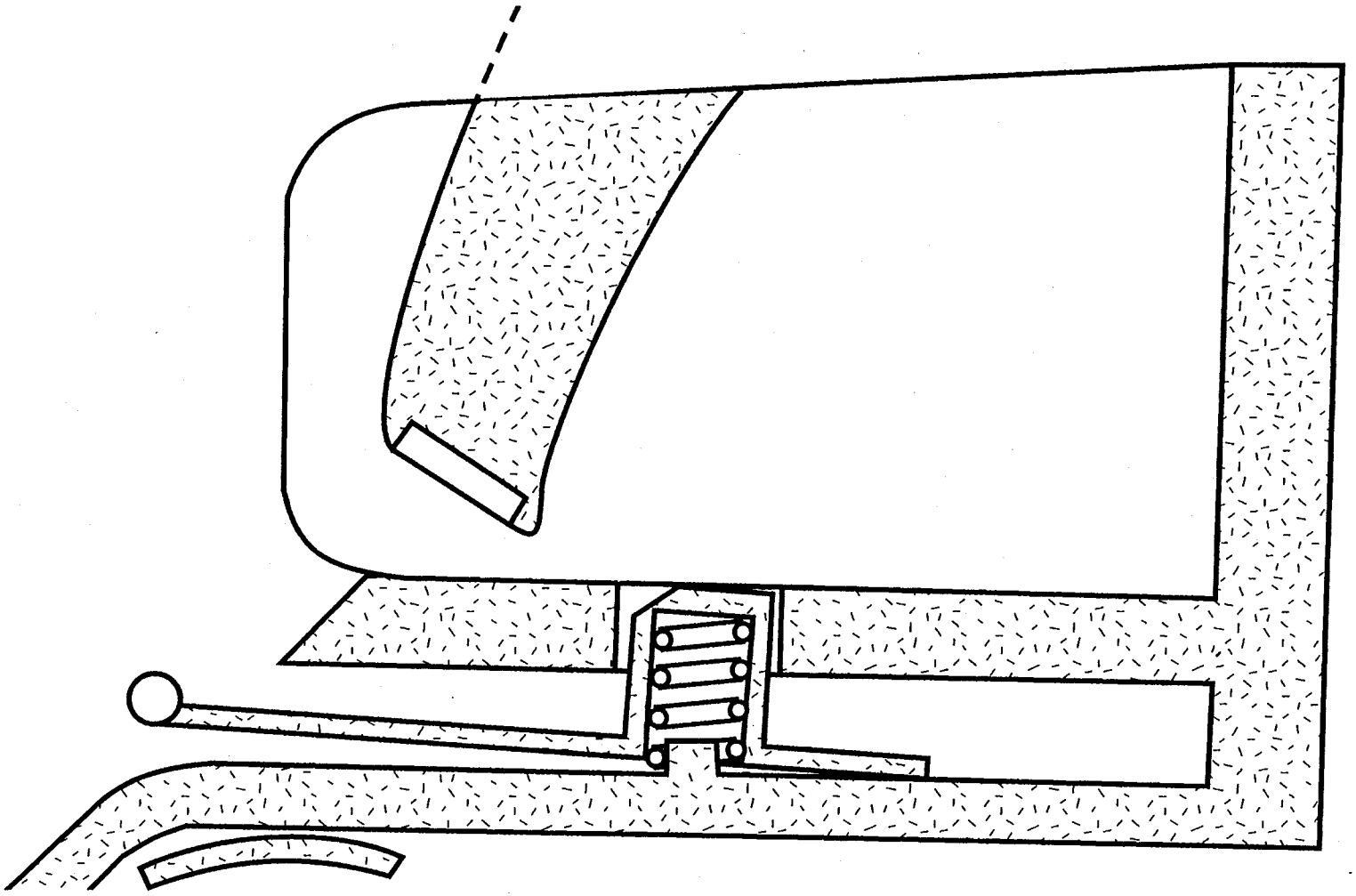
FIG. 3
Figure 4:
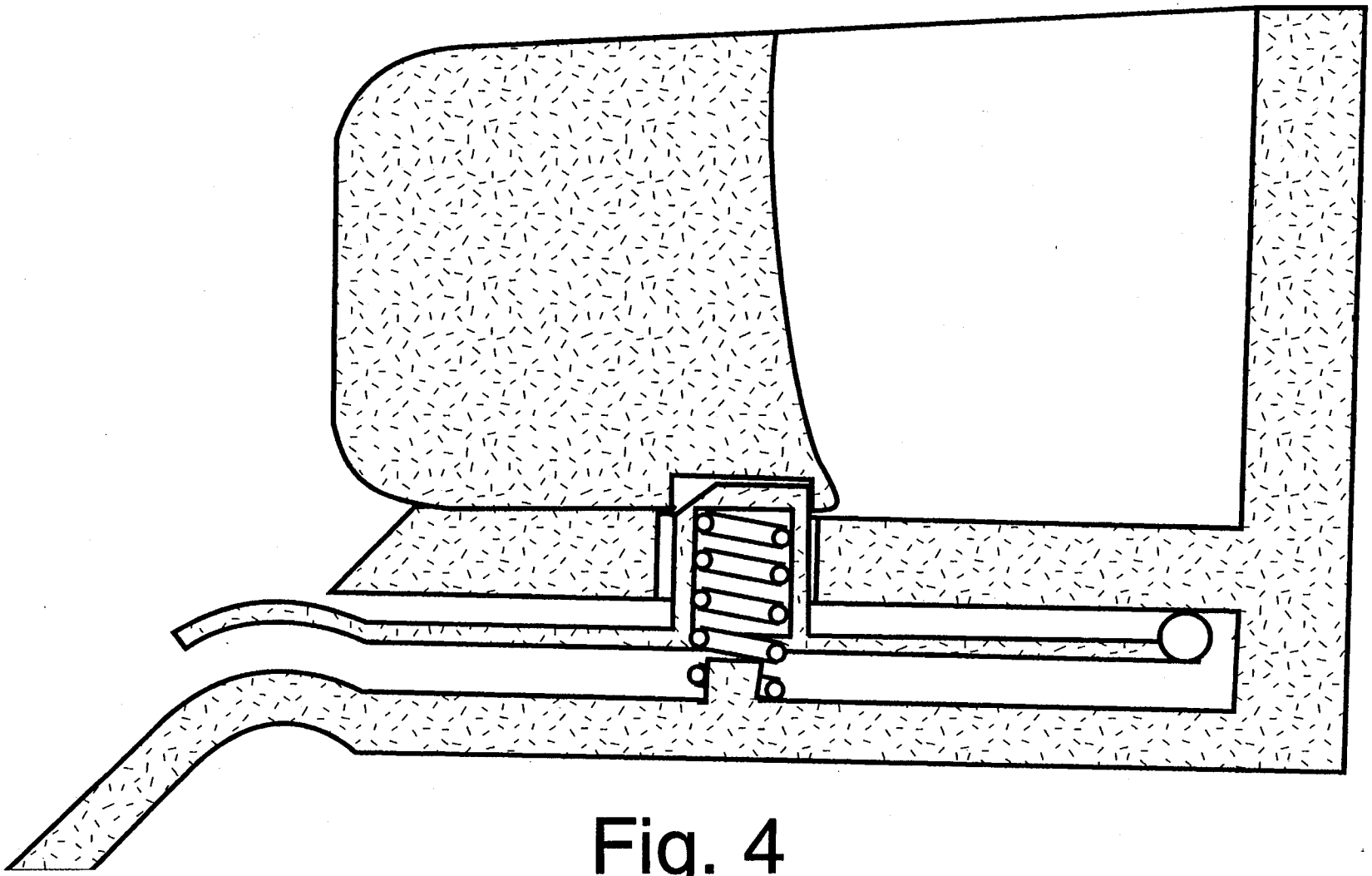

The flat steel bar 4 pivots at a transversely horizontal pin 6 which can be located at the front or at the rear ends of the horizontal part of the trigger guard 5 as shown in FIGS. 1 and 3 respectively.

Our invention is simple in construction and reliable in operation. It reduces the risk of accidental or intentional injuries in circumstances like unsupervised children playing with firearms and law enforcement officers whose guns are removed from them. This safety device proves useful as it is concealed within the gun and cannot be unlocked by any other means exempt by the use of a strong magnet. Another advantage is that the magnet to unlock the gun is not built into the gun.

This safety mechanism can be adapted to pistols, rifles, shotguns and most kind of firearm.

We claim:

1. A safety apparatus that prevents the unauthorized firing of a firearm, said safety apparatus comprising:

a trigger with a cavity disposed within the lower end of said trigger, a trigger guard having a chamber disposed below said trigger, said chamber having an upper and a lower surface, a flat steel bar pivotably mounted upon a transversely mounted pin within said chamber, a hollow pin that removably engages said cavity, said hollow pin being welded to a surface of said flat steel bar which faces the cavity, and further having an open end which faces said lower surface of said chamber, a spring which is at one end disposed within said open end of said hollow pin, and at another end contacting said lower surface of said chamber, and further biasing said pin upwards into said cavity, a magnet carried upon the shooting hand of the shooter, said magnet acting against the spring bias to disengage the hollow pin from said cavity, allowing the trigger to be pulled.

* * * * *